United States Patent [19]

Rapp et al.

[11] 4,091,771

[45] May 30, 1978

[54] INJECTION DEVICE FOR INJECTING AN ADDITIONAL, SMALL FUEL QUANTITY INTO AN EXTERNAL AUTO-IGNITION INTERNAL COMBUSTION ENGINE OPERATING ACCORDING TO THE STRATIFIED-CHARGE PRINCIPLE

[75] Inventors: Wolfgang Rapp, Esslingen; Dieter Schmidt, Stuttgart, both of Germany

[73] Assignee: Daimler-Benz Aktiengesellschaft, Germany

[21] Appl. No.: 576,445

[22] Filed: May 12, 1975

[30] Foreign Application Priority Data

May 22, 1974 Germany ..... 2424800

[51] Int. Cl.[2] ..... F02B 19/10; F02B 19/16

[52] U.S. Cl. ..... 123/32 SP; 123/139 AS; 123/139 AK

[58] Field of Search ..... 123/139 AS, 139 AB, 123/139 AR, 139 AP, 32 SP, 32 ST, 32 D

[56] References Cited

U.S. PATENT DOCUMENTS

| | | | |
|---|---|---|---|
| 2,055,578 | 9/1936 | Hurst | 123/139 AS |
| 2,582,539 | 1/1952 | Grimod | 417/494 |
| 2,739,643 | 3/1956 | Voit | 239/90 |
| 3,058,455 | 10/1962 | Hofer et al. | 123/140 R |

FOREIGN PATENT DOCUMENTS

| | | | |
|---|---|---|---|
| 158,033 | 1/1933 | Switzerland | 123/139 AS |

*Primary Examiner*—Ronald B. Cox
*Attorney, Agent, or Firm*—Craig & Antonelli

[57] ABSTRACT

Injection device for injecting fuel into a combustion space such as an auxiliary combustion space of an external auto-ignition internal combustion engine of the type operating on the stratified-charge principle. The injection device includes a housing accommodating a movable pump plunger, a movable nozzle needle controlling the nozzle orifice opening into the auxiliary combustion space, and a movable piston-type storer. The pump plunger is configured to close off respective fuel return and fuel supply lines during its pumping stroke, at which time it effects a build up of pressure resulting in movement of the piston type storer until a predetermined sufficient pressure is reached to force the nozzle needle away from the closed position to thereby effect injection of fuel into the auxiliary combustion space. An adjustable stop is provided at the piston-type storer and the supply fuel to the fuel supply line is under an adjustable pre-pressure, whereby the adjusted pre-pressure and the configuration of the piston-type storer control the amount of fuel injection.

21 Claims, 2 Drawing Figures

FIG. 1
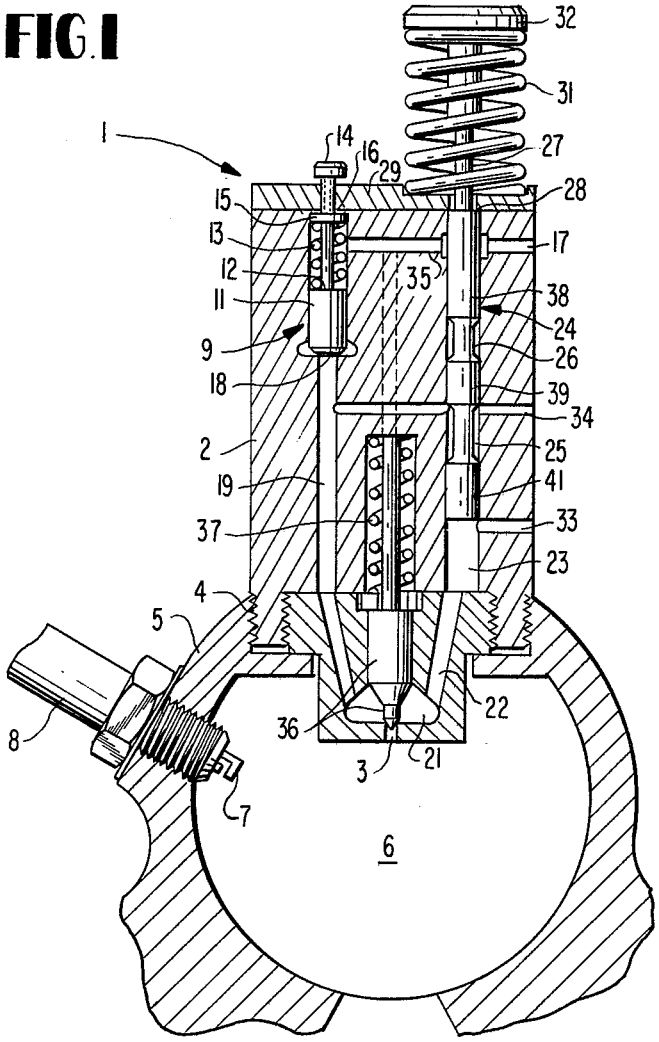
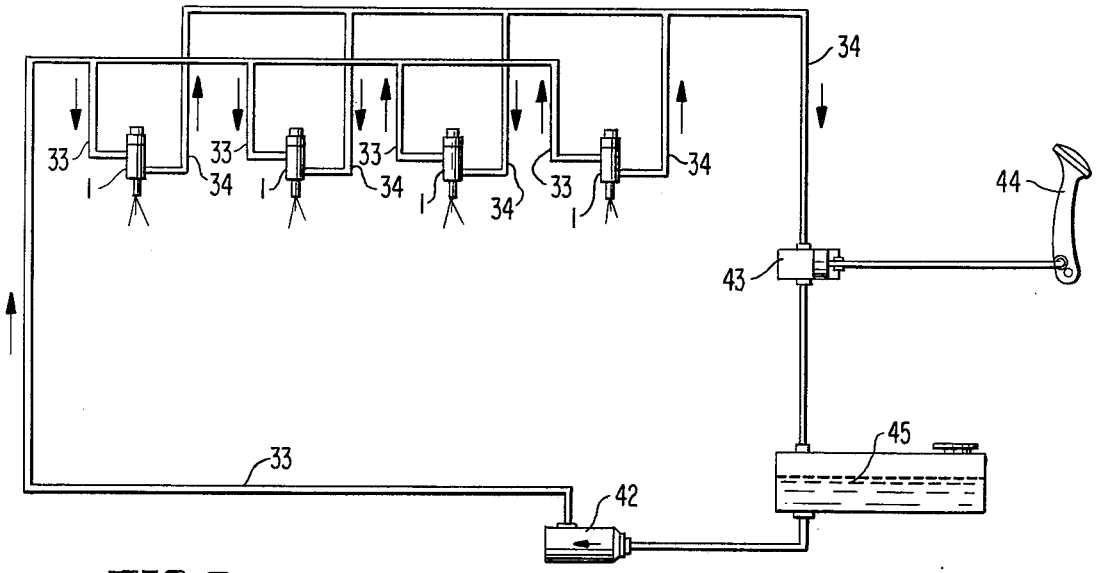
FIG. 2

INJECTION DEVICE FOR INJECTING AN ADDITIONAL, SMALL FUEL QUANTITY INTO AN EXTERNAL AUTO-IGNITION INTERNAL COMBUSTION ENGINE OPERATING ACCORDING TO THE STRATIFIED-CHARGE PRINCIPLE

BACKGROUND AND SUMMARY OF THE INVENTION

The present invention relates to an injection device for injecting fuel into a combustion space such as an auxiliary combustion space of an external auto-ignition internal combustion engine of the type operating on the stratified-charge principle. More particularly, the present invention is directed to such an injection device which includes a mechanically operated pump plunger.

With internal engines operated on the stratified-charge principle, the fuel-air mixture in the area of the spark plug is enriched by additional supply of fuel, while in other areas of the combustion space a homogeneous lean mixture, or under some conditions, also a fuel-air mixture progressively becoming leaner and more difficult to ignite, is stratified in the main combustion chamber. In such an arrangement, the spark plug is located in a small-volume auxiliary chamber, or so-called ignition chamber, and only a very small additional quantity of fuel must be apportioned to this chamber because of its small volume in order to obtain therein a richer, ignitable mixture.

It has been contemplated to bring a corresponding fuel-air mixture into such an auxiliary chamber by way of a small auxiliary valve. It has further been contemplated to use electro-magnetically operated injection valves which render possible a low-pressure injection of small fuel volumes during the suction stroke. It has also been attempted to inject the required small fuel volumes (quantities) with high-pressure injection devices. However, with such high-pressure injection devices, limitations result for the accurate dosage because of construction-limiting elasticities of the high-pressure injection devices.

The present invention contemplates a device which avoids the above-noted disadvantages. More particularly, the present invention contemplates an injection device constructed according to different principles than those discussed above. The injection device contemplated by the present invention is operated mechanically and can hold the control of the desired dosage of the small fuel injection within narrow limits. According to a preferred embodiment of the invention, the invention device operates on a pump-nozzle principle and is specifically adapted for the mounting conditions at the engine. The injection device of the present invention is constructed so as to decrease the adverse effects of the elasticity of the structural parts and the compressibility of the fuel as much as possible.

In other words, the present invention is directed to an improved mechanically operated injection device for the high-pressure injection of a very small, dosed fuel quantity, which device works according to the pump-nozzle principle and which avoids the effects of the elasticity of the structural parts in such types of devices as much as possible.

According to the invention, the dosed fuel quantity, which is small in relation to the total fuel consumption of the internal combustion engine, is controlled between zero and a desired maximum quantity by utilizing a pump plunger of small diameter arranged in an also small injection device housing, with fuel being supplied to the injection device under an adjustable pre-pressure and with the injection device including a fuel-pressure responsive storer means. In preferred embodiments, the storer means is a spring-loaded piston-type storer. The filling of the piston-type storer is controlled by the pump plunger. The pump plunger is provided with ring grooves, which depending upon the position of the pump plunger, assist in communicating the piston-type storer with fuel passages, including fuel supply and fuel return passages to the injection device housing.

In a preferred embodiment of the present invention, the pump element and the injection nozzle form a single structural unit. The pressure line to the nozzle is as short as possible whereby the effect of elasticity of the structural parts and the compressibility of the fuel are correspondingly decreased.

The pump plunger itself is actuated through an additional cam from the engine camshaft.

The advantages of the injection device of the present invention, in contrast to known arrangements, result in the possibility of bringing a very small, quantitatively regulated fuel quantity through high-pressure injection, also with higher cylinder pressures during the compression stroke, into the small auxiliary chamber around the spark plug, with a device which, with correspondingly constructed cylinder head, is operated from the engine camshaft and usable for a carburetor and injection engines. Through this arrangement, mounting and installation difficulties can be avoided thanks to the simple hydraulic quantity regulation.

According to a further advantageous feature of the injection device of the present invention, a fuel return line is provided in the housing of the injection device which, for a corresponding position of the pump plunger, is communicable directly with the front side of the piston of the piston-type storer through a ring groove, which ring groove is located remotely from the auxiliary combustion space. Further, a fuel supply line is provided adjacent the auxiliary combustion space which, in the starting position of the pump plunger, is connected through a fuel passage with the nozzle orifice closable by the nozzle needle, from which nozzle needle area a further fuel passage also leads to the front side of the piston of the piston-type storer. Furthermore, in the preferred embodiment of the present invention, a leak-off fuel line is provided in the injection device which is connected directly with the rear portion of the spring chamber of the piston-type storer through ring groove located further away from the auxiliary combustion space than the above-mentioned ring grooves.

In operation of the injection device of the present invention, the pump plunger is constructed such that, during its delivery stroke, it closes off the fuel supply and fuel return to the injection device housing and so raises the pressure in a pressure chamber surrounding the nozzle orifice and the pressure at the piston-type storer until the pressure in the pressure chamber lifts the nozzle needle against the resistance of the nozzle needle spring, at which time the nozzle orifice becomes free and fuel is injected into the auxiliary combustion space and the delivery quantity is determined thereby that the center ring groove opens the fuel return. Since the pressure chamber in the area of the nozzle orifice is communicated by respective separate fuel passages with the fuel supply line and, by way of the additional fuel passage also leading to the piston-storer, with the fuel return line, the delivered fuel flows around the nozzle needle so as to cool it. In the rest or lower dead center position of the pump plunger, with the fuel supply and fuel return lines open, a forced flow-through of the fuel around the closed valve seat of the injection nozzle is provided. This last-mentioned measure serves for the avoidance of fuel vapor lock and for the internal cooling of the nozzle which projects into the combustion space and which can hardly transfer heat to the incoming fresh gas or over a larger injection quantity.

With the injection device of the present invention, shortly after the beginning of the pump plunger delivery stroke, the supply and return passages are closed by the pump plunger; at the end of the delivery stroke, the return passage is opened by a rear control edge. The effective delivery stroke is only a part of the total pump plunger stroke movement whereby the end of delivery occurs when the maximum pump plunger velocity is reached, as is also the case with previously contemplated pump arrangements.

The piston-type storer absorbs or accommodates the fuel delivered by the pump plunger on its delivery stroke. In preferred embodiments of the invention, the storer volume of the piston-type storer is larger than the fuel volume displaced by the pump plunger.

In preferred embodiments of the invention, the adjustable fuel pre-pressure supplied to the injection device is supplied by an additional fuel supply pump which always delivers the same quantity, with the pressure at which the fuel is delivered to the injection device being controlled by a throttle valve.

The present invention also contemplates other preferred embodiments utilizing a membrane storer or a pressure tank in place of the piston-type storer.

These and further objects, features and advantages of the present invention will become more obvious from the following description when taken in connection with the accompanying drawings, which show, for purposes of illustration only, a single embodiment in accordance with the present invention.

BRIEF DESCRIPTION OF THE DRAWINGS

FIG. 1 is a side schematic sectional view depicting an injection device constructed in accordance with the present invention and in position at an auxiliary combustion chamber; and FIG. 2 is a schematic illustration showing utilization of the injection device of the present invention in conjunction with a four-cylinder Otto internal combustion engine.

DETAILED DESCRIPTION OF THE DRAWINGS

Referring to FIG. 1, injection device generally designated by the reference numeral 1 includes a housing 2 provided with a thread 4 at its end adjacent to its nozzle orifice 3. The thread 4 is threadably engageable with corresponding threads at cylinder head 5 in such a position that the nozzle orifice faces into an auxiliary combustion space or chamber 6. Also, electrodes 7 of a spark plug 8 reach into this auxiliary combustion chamber 6.

A piston-type storer generally designated by the reference numeral 9 having a piston 11 is provided in housing 2, the rear side 12 of which is supported by a spring 13 and the other end thereof being pressed against a stop 15 adjustable by a screw 14. The stop may also be non-adjustable. The rear spring space 16 of the piston-type storer 9 is connected to a fuel leak line 17. Opposite the front side 18 of piston 11, the piston-type storer 9 is connected with a fuel passage 19. The other end of the fuel passage 19 opens into a chamber 21 adjacent the nozzle orifice 3, this chamber 21 also opening into a fuel passage 22. Passage 22 connects chamber 21 with a cylindrical bore 23 in which pump plunger generally designated by the reference numeral 24 is guided. The pump plunger 24 is provided with a ring groove 25 adjacent the nozzle orifice 3, a center ring groove 26 further away from the nozzle orifice 3 and a ring groove 27 located most remotely from the nozzle orifice 3. The pump plunger butts against a cover plate 28 of housing 2 with a shoulder 28 formed by the ring groove 27, since spring 31, which supports itself at one side at the cover plate 29 and at the other side at a pump plunger head 32, continuously forces the pump plunger 24 toward the position shown in the drawing such that the plunger is maintained in said position in the absence of any other forces acting on the plunger.

A bore 33 is provided in housing 2 which connects the cylindrical bore 23 with a fuel supply line. A further bore 34 connects the fuel passage 19 with a cylindrical bore 23 and this again with a fuel return line. Another bore 35 is provided in housing 2 which connects the rear spring space 16 with the cylindrical bore 23 and this again with the fuel leak line 17.

A nozzle needle 36 is arranged in the housing which is pressed toward the nozzle orifice 3 to close same by the pressure of spring 37.

In the rest or lower dead center position of the pump plunger 24 shown in FIG. 1, the fuel supply line 33 is connected to the fuel return line 34 through passage 33, fuel passage 22, chamber 21 and fuel passage 19. Fuel passage 19 also communicates with the piston-type storer 9. Further, portions 39 and 41 of the pump plunger are formed by ring grooves 25 and 26.

During operation of the injection device from the rest or lower dead center position to an upper dead center position, the pump plunger 24 is operated on by a cam (against head portion 32, for example) so that first, the portions 39 and 41 of the pump plunger 24 close the fuel supply line 33 and fuel return line 34. The fuel available in the system is then pressurized by further movement of the pump plunger 24 and is, in part, received by the piston-type storer 9 until such time as the pressure in the piston-type storer, in the fuel passages 19 and 22, as well as in chamber 21 become so high that the nozzle needle 36 acting against the pressure of the spring 37 is lifted off the nozzle orifice 3 and fuel is delivered into the auxiliary combustion space 6. After injection of a small fuel quantity, the spark plugs 7, 8 is fired.

The fuel quantity required for this system, of the order of less than 1 $mm^3$ per firing, requires a small diameter of the pump plunger 24, which, in the present case, has a diameter of approximately 2 mm.

With the small plunger diameter of the inventive device, a quantity regulation of the customary type, through rotation of the plunger with a slanted control edge, is not very feasible. The pump plunger 24 supplies, therefore, the same certain quantity (volume) each time through the constant effective stroke, less certain leak losses which can drain off through bore 35 and the fuel leak line 17.

The regulation of the fuel quantity is accomplished by the piston-type storer 9 in cooperation with the controllable pre-pressure supply by way of line 33. The piston-type storer 9 has, from its start position to the solid or adjustable stop 15, an adjustable storer volume which is somewhat larger than the displaced delivery volume of the pump plunger. Dependent on the controllable fuel pre-pressure which is preferably between 2 to 10 kp/cm$^2$, but considerable less than the opening pressure of the injection nozzle, the spring-loaded piston 11 adjusts itself to a corresponding distance from stop 15 onto which the piston 11, during the delivery stroke abuts after absorbing a storer 9 volume into the piston-type storer dependent on the position of the stop 15. Only then can the pressure in the pressure chamber build up sufficiently to open the injection nozzle valve, that is, for lifting the nozzle needle 36 against the pressure of the spring 37 and to inject the remaining quantity of the stroke volume through the nozzle orifice 3 into the auxiliary combustion space 6.

Therefore, the maximum injection quantity occurs at maximum pre-pressure when piston 11, at the beginning of fuel delivery, almost makes contact with stop 15. A reduced pre-pressure means a smaller injection quantity since a portion of the delivery volume is being accommodated by the piston-type storer 9 and is released from there only after the end of injection of this working stroke. In the extreme case, that is, with minimum pre-pressure, the quantity of injection may, in fact, decrease to zero.

In place of a piston-type storer, a membrane-type storer or a small closed pressure cell may also be used which, up to a solid stop is pressure dependent, volume changeable and can be arranged anywhere in the pressure space.

The fuel pressure in the pressure chamber which exists with open fuel supply and fuel return passages 33, 34 and thereby also acts on the storer 9, is produced by a quantity-constant working fuel delivery pump 42 (see FIG. 2). This fuel pressure or pre-pressure is controlled through an adjustable throttle valve 43 which is arranged in the return-collecting line from a number of diffusioned injection devices in parallel of a multi-cylinder engine and, dependent on the flow cross section corresponding to flow-through quantity, allows the adjustment of defined pressures ahead of the throttle valve 43 and is adjusted in dependence of the position of the driver pedal 44. Inasmuch as the fuel return line 34 always again is brought into connection with the fuel supply line 33, also the pre-pressure in the fuel supply line 33 can be controlled or influenced through the throttling of the fuel returning to the fuel tank 45.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Injection device for injecting fuel into a combustion space such as an auxiliary combustion space of an external auto-ignition internal combustion engine of the type operating on a stratified-charge principle; said injection device comprising:

an injection device housing, at least one fuel chamber provided in said housing for accommodating a quantity of fuel, means for supplying fuel to said at least one fuel chamber, a small diameter pump plunger movably displaceable in said housing for controlling a throughflow of fuel through the at least one fuel chamber and for raising the pressure of said fuel, said small diameter pump plunger being displaceable from an upper position to a lower dead center position, a nozzle for communicating the fuel in said at least one fuel chamber to an auxiliary combustion space, and means for regulating the quantity of fuel to be injected by the injection device including:

means for controlling an inlet pressure of the fuel supplied to said at least one fuel chamber by said fuel supplying means, and a spring loaded variable volume fuel storer means separate from said pump plunger and said nozzle and located in said housing for storing fuel in said housing during at least part of the raising of the pressure of said fuel by said pump plunger, said spring loaded variable volume storer means being regulated by an initial fuel pressure such that an amount of fuel to be injected through the injection device is metered between a maximum quantity and a zero quantity, and wherein, in the lower dead center position of the pump plunger, fuel passes through said at least one fuel chamber to cool the nozzle and to prevent fuel vapor lock.

2. Device according to claim 1, in an internal combustion engine which includes a main combustion space and an auxiliary combustion space in communication therewith, wherein a further fuel supply means is provided for supplying a major portion of the fuel consumed by said engine to said main combustion space.

3. Device according to claim 1, wherein said storer means is a piston-type storer having a resiliently biased storer piston movable in response to increased fuel pressure.

4. Device according to claim 3, wherein said pump plunger includes ring grooves for controlling respective fuel supply and return passages in response to the position of the pump plunger, and wherein pressure faces of said storer piston and said pump plunger are in fluid communication with one another.

5. Injection device for injecting fuel into a combustion space such as an auxiliary combustion space of an external auto-ignition internal combustion engine of the type operating on the stratified-charge principle; said injection device comprising:

an injection device housing, means for supplying fuel to said housing under an adjustable pre-pressure, a small diameter pump plunger movably displaceable in said housing for raising the pressure of said fuel, a nozzle for communicating the fuel in said housing to an auxiliary combustion space, and a piston-type fuel storer means having a resiliently biased storer piston movable in response to increased fuel pressure arranged separate from said pump plunger and said nozzle and located in said housing for storing fuel in said housing during at least a part of the raising of the pressure of said fuel by said pump plunger, said pump plunger includes ring grooves for controlling respective fuel supply and return passages in response to the position of the pump plunger, pressure faces of said piston and said pump plunger are in fluid communication with one another, a first of said ring grooves communicates said fuel return passage with the pressure face of said storer piston when said pump plunger is in a first starting position, said fuel supply passage is located closer to an auxiliary combustion space than is said fuel return passage and is communicated with a nozzle space around a movable nozzle needle of said nozzle when said pump plunger is in said first position, and a further fuel passage communicates said nozzle space with the pressure face of said storer piston.

6. Device according to claim 5, wherein said pump plunger is configured to close said fuel return and supply passages during a first portion of its delivery stroke movement away from said first position with a resultant increase in fuel pressure in said nozzle space and at said storer piston until sufficient fuel pressure occurs in said nozzle space to lift the nozzle needle against the force of a needle spring and thereby open a nozzle orifice to admit fuel to the auxiliary combustion space, and wherein one of said ring grooves is positioned to communicate said return passage with said further fuel passage at maximum velocity of said pump plunger.

7. Device according to claim 5, wherein said fuel supply passage is communicated with said nozzle space by a nozzle supply passage opening into said nozzle space in the vicinity of the nozzle orifice, and wherein said further fuel passage opens into said nozzle space in the vicinity of the nozzle orifice such that fuel delivered to said nozzle space flows around the nozzle needle so as to cool the same whereby fuel vapor lock is avoided.

8. Device according to claim 6, wherein said fuel supply passage is communicated with said nozzle space by a nozzle supply passage opening into said nozzle space in the vicinity of the nozzle orifice, and wherein said further fuel passage opens into said nozzle space in the vicinity of the nozzle orifice such that fuel delievered to said nozzle space flows around the nozzle needle so as to cool the same whereby fuel vapor lock is avoided.

9. Device according to claim 1, wherein the variable storage volume of said storer means is greater than the volume displaceable by said pump plunger.

10. Device according to claim 3, wherein the storage volume formed by displacement of said storer piston is larger than the volume displaceable by said pump plunger.

11. Device according to claim 6, wherein a storage volume formed by displacement of said storer piston is larger than the volume displaceable by said pump plunger.

12. Device according to claim 8, wherein a storage volume formed by displacement of said storer piston is larger than the volume displaceable by said pump plunger.

13. Injection device for injecting fuel into a combustion space such as an auxiliary combustion space of an external auto-ignition internal combustion engine of the type operating on the stratified-charge principle; said injection device comprising:

an injection device housing, at least one fuel chamber provided in said housing for accommodating a quantity of fuel, means for supplying fuel to said at least one fuel chamber under an adjustable pre-pressure, a small diameter pump plunger movably displaceable in said housing for controlling a throughflow of fuel through the at least one fuel chamber and for raising the pressure of said fuel, said small diameter pump plunger being displaceable from an upper position to a lower dead center position, a nozzle for communicating the fuel in said at least one fuel chamber to an auxiliary combustion space, and a spring loaded fuel pressure storer means separate from said pump plunger and said nozzle and located in said housing for storing fuel in said housing during at least a part of the raising of the pressure of said fuel by said pump plunger, said spring loaded variable storer means being regulated by an initial fuel pressure such than an amount of fuel to be injected is metered between a maximum quantity and a zero quantity, said means for supplying fuel to said at least one fuel chamber under an adjustable pre-pressure includes:

a volume constant delivery pump located remote from said housing, and a throttle valve in a line between said delivery pump and said housing for varying the pressure of fuel supplied to said housing, wherein, in the lower dead center position of the pump plunger, fuel passes through said at least one fuel chamber to cool said nozzle and to prevent fuel vapor lock.

14. Device according to claim 5, wherein said means for supplying fuel to said housing under an adjustable pre-pressure includes:

a volume constant delivery pump located remote from said housing, and a throttle valve in a line between said delivery pump and said housing for varying the pressure of fuel supplied to said housing.

15. Device according to claim 8, wherein said means for supplying fuel to said housing under an adjustable pre-pressure includes:

a volume constant delivery pump located remote from said housing, and a throttle valve in a line between said delivery pump and said housing for varying the pressure of fuel supplied to said housing.

16. Device according to claim 12, wherein said means for supplying fuel to said housing under an adjustable pre-pressure includes, a volume constant delivery pump located remote from said housing, and a throttle valve in a line between said delivery pump and said housing for varying the pressure of fuel supplied to said housing.

17. Injection device for injecting fuel into a combustion space such as an auxiliary combustion space of an external auto-ignition internal combustion engine of the type operating on a stratified charge principle; said injection device comprising:

an injection device housing, means for supplying fuel to said housing, a small diameter pump plunger moveably displaceable in said housing for raising the pressure of said fuel, a bore means for accommodating said pump plunger, fuel supply and fuel return passages terminating in said bore means so as to be controlled by displacement of said pump plunger, a nozzle for communicating the fuel in said housing to an auxiliary combustion space, said nozzle including a fuel accommodating chamber, means for communicating said fuel supply passage with said fuel accommodating chamber and said fuel accommodating chamber with said fuel return passage such that, in a rest position of said pump plunger, fuel traverses the injection device so as to cool the injection device and prevent fuel vapor lock, and means for regulating the quantity of fuel to be injected by the injection device including:

means for controlling an inlet pressure of the fuel supplied to said housing by said fuel supplying means, and a variable volume fuel storer means separate from said pump plunger and said nozzle and located in said housing for storing fuel in said housing during at least part of the raising of the pressure of said fuel by said pump plunger, said inlet pressure controlling means adjusting the pressure of the supplied fuel acting upon said spring loaded variable volume storer means such that, upon reaching a predetermined fuel pressure, a small dosed quantity of fuel is injected through the nozzle of the injection device for high pressure injection.

18. Device according to claim 1, wherein said variable volume storer means includes a pressure responsive element mounted in said housing.

19. Device according to claim 1, wherein said pump plunger includes a control edge cooperable with a fuel return line such that at a maximum displacement of said pump plunger, said control edge opens the fuel return line so as to terminate an injection operation.

20. Device according to claim 1, wherein said means for controlling the inlet pressure of the fuel includes a volume constant fuel delivery pump communicating with said injection housing, and means interposed between said fuel delivery pump and said housing for varying the pressure of fuel supplied to said housing.

21. An external auto-ignition internal combustion engine operating on a stratified-charge principle, the engine comprising an auxiliary combustion space, a spark plug means provided in said auxiliary combustion space for ignition a fuel-air mixture therein, and an ignition device for injecting fuel in the auxiliary combustion space, said injection device comprising:

an injection device housing, at least one fuel chamber provided in said housing for accommodating a quantity of fuel, means for supplying fuel to said at least one fuel chamber, a small diameter pump plunger movably displaceable in said housing for controlling a through-flow of fuel through the at least one fuel chamber and for raising the pressure of said fuel, said small diameter pump plunger being displaceable from an upper position to a lower dead center position, a nozzle for communicating the fuel in said at least one fuel chamber to an auxiliary combustion space, and means for regulating the quantity of fuel to be injected bytthe injection device including:

means for controlling an inlet pressure of the fuel supplied to said at least one fuel chamber by said fuel supplying means, and a spring-loaded volume storer means separate from said pump plunger and said nozzle and located in said housing for storing fuel in said housing during at least a part of the raising of the pressure of said fuel by said pump plunger, said spring-loaded variable volume storer means being regulated by an initial fuel pressure such that an amount of fuel to be injected through the injection device is metered between a maximum quantity and a zero quantity, and wherein, in the lower dead center position of the pump plunger, fuel passes through said at least one fuel chamber to cool the nozzle and to prevent fuel vapor lock.

* * * * *